United States Patent [19]

Hyde et al.

[11] Patent Number: 4,522,616

[45] Date of Patent: Jun. 11, 1985

[54] METHOD AND APPARATUS FOR FORMING CIGARETTE FILTER RODS

[75] Inventors: Rebecca A. Hyde, Charlotte; Kenneth R. Krimminger, Oakboro; Robert E. Swander, Charlotte, all of N.C.

[73] Assignee: Celanese Corporation, New York, N.Y.

[21] Appl. No.: 356,708

[22] Filed: Mar. 10, 1982

[51] Int. Cl.[3] ..... A24C 5/50

[52] U.S. Cl. ..... 493/44; 493/50; 28/283

[58] Field of Search ..... 493/44, 48, 50, 42, 493/39; 19/65 T, 66 T; 28/283; 156/200, 166

[56] References Cited

U.S. PATENT DOCUMENTS

| | | | |
|---|---|---|---|
| 3,016,945 | 1/1962 | Wexler | 156/200 |
| 3,032,829 | 5/1962 | Mahoney et al. | 19/65 T |
| 3,050,430 | 8/1962 | Gallagher | 156/166 |
| 3,095,343 | 6/1963 | Berger | 28/283 X |
| 3,099,594 | 7/1963 | Caines et al. | 156/152 |
| 3,106,501 | 10/1964 | Cobb, Jr. et al. | 493/43 X |
| 3,173,188 | 3/1965 | Wexler | 156/200 |
| 3,204,295 | 9/1965 | Amos | 19/65 T X |
| 3,380,131 | 4/1968 | Gray | 19/66 T X |
| 3,636,825 | 1/1972 | Randall et al. | 226/195 X |
| 3,831,501 | 8/1974 | Bevington, Jr. | 493/44 |
| 4,411,641 | 10/1983 | Suzuki et al. | 493/50 X |

*Primary Examiner*—James F. Coan

*Attorney, Agent, or Firm*—Robert J. Blanke

[57] ABSTRACT

The present invention relates to high speed processes and apparatus for the manufacture of cigarette filter rods. In accordance with this invention it has been discovered that in a process of manufacturing filter elements from opened and deregistered crimped continuous filament tow, wherein said tow is conducted from a mechanical forwarding means through an aspirating jet positioned adjacent a compacting means and wherein means are provided for dissipating aspirating fluid, that filter rod pressure drop and weight variations are reduced by causing the opened and deregistered tow to contact a drag inducing tow width and direction controlling means positioned substantially intermediate said mechanical forwarding means and said aspirating jet.

9 Claims, 8 Drawing Figures

METHOD AND APPARATUS FOR FORMING CIGARETTE FILTER RODS

The present invention relates to improved processes and apparatus for the production of cigarette filter rods from continuous filament tow. More specifically, the invention relates to improved high speed processes and apparatus for the production of cigarette filter rods of reduced variability having high tow utilization in terms of pressure drop per unit rod weight.

In the last decade, the overwhelming proportion of commercially available cigarette filters have comprised longitudinally extended crimped filaments bonded to one another at their contact points by solvation bonds. The procedure for producing such filters involves producing a tow or untwisted bundle of several thousand continuous filaments, crimping the tow, opening the tow to deregister adjacent crimps, fluffing the tow to permit subsequent uniform application of a plasticizer, pulling the tow through the zones of plasticizer application and thereafter treating the plasticized tow to reduce its cross-sectional size until it is approximately equal to the cross-sectional size of a cigarette. The condensed mass is formed into a coherent structure, typically by wrapping paper around it and severing the wrapped tow into rods of predetermined length and thereafter curing the rods to affect bonding between adjacent filaments at their contact points.

Because of the expense of the tow component of the cigarette filter, it is desirable that the greatest amount of tow crimp and hence, tow bulk be attained per unit weight of filamentary material. One widely-used method of opening the tow consists of subjecting the tow while being fed along a predetermined path to a differential gripping action between a plurality of points spaced from one another transversely of the path so that certain laterally-spaced sections of the tow are positively gripped relative to other laterally-spaced sections of the tow. In this manner, there is produced as a function of the differential positive gripping of the tow, a relative shifting of adjacent filaments longitudinally of the tow, whereby the crimps are moved out of registry with one another. The longitudinal relative displacement of the fibers usually is combined with a relative lateral displacement between adjacent filaments of the tow whereby the combination of the two relative filaments movements bring about a complete opening of the tow.

This differential gripping action is accomplished by the provision before the plasticizing chamber of a pair of rollers, one of which is a smooth surface and the other of which is grooved over its entire periphery. The tow is maintained under tension upstream of the differential gripping action so that after release of the tension on a downstream side of the differential gripping action, the tow blooms into a fluffy band which then passes through the plasticizer applying chamber, optionally after further lateral opening of the tow band, prior to feeding the tow band to the filter rod-making machine.

Another widely-used method of opening tow is that set forth in U.S. Pat. No. 3,099,594 wherein crimped continuous tow is fed into a jet supplied with high velocity gas whereby the crimp in the filaments is put out of registry. More specifically, in the process of U.S. Pat. No. 3,099,594, a continuous multifilament crimped tow is withdrawn from a supply package by means of a feed roll pair and passed by the suction of a blooming jet over a suitable plasticizer applicator into a blooming jet. In the blooming jet, the tow is subjected to an explosive expansion of compressed air while in the jet, the bloomed tow is exposed to a fog of atomized plasticizer liquid. The plasticized tow is expelled from the jet under the influence of the expanding air flow into a feed roll pair operated at a somewhat slower speed than the first feed roll pair so that the tow is in a state of relaxation. The opened, plasticized and crimp deregistered tow is then passed into a filter rod-making machine.

While in the production of cigarette filter rods, optimum openness is desirable, the exact value for optimum openness varies from tow product to tow product. For instance, when a low degree of deregistry between the individual filaments comprising a tow bundle occurs, the resultant filter rods produced from such a tow bundle are too soft, difficult to wrap initially in forming the rods as well as in joining the rods to tubes of tobacco and making cigarette filters, and which do not spring after compression (as between the fingers or lips during smoking) with attended channelling of the smoke. For the same reasons, the opening equipment should not operate so strongly on the tow that the crimps are pulled out and the tow is of diminished bulk; while this could be compensated for by utilizing heavier tows, the resultant plugs would be so dense as to make it exceedingly uncomfortable to draw smoke through the filter, i.e., its pressure drop would be too high. Additionally, the smoke removal efficiency of the filter rod must be maintained at acceptable levels.

One means for maximizing tow utilization, that is to say, improving pressure drop per unit rod weight, is set forth in U.S. Pat. No. 3,050,430. In U.S. Pat. No. 3,050,430, an improvement is set forth in the process sequence wherein filaments which have been previously opened up and treated with plasticizer are forwarded into a garniture for compacting and forming. Rather than employing a mechanical type of treatment to pull the filaments into the garniture whereby a substantial amount of crimp is lost, the Patentee pushes the band of open-continuous crimped filaments into the rod compacting and forming means. The filaments fed in this manner are in a somewhat relaxed and untensioned state whereby a relatively large percentage of each filament may be positioned somewhat crosswise or perpendicular to the longitudinal axis of the filament bundle. To achieve this result, a pneumatic transport or forwarding jet, such as that disclosed in U.S. Pat. No. 3,016,945, is positioned reasonably adjacent the tongue of a rod forming member or garniture. The tongue is perforated so that air or aspirating fluid employed to push the filamentary material into the tongue will be radially exhausted. Alternatively, as disclosed in U.S. Pat. No. 3,173,188, an inverted shroud may be positioned intermediate the forwarding jet and the perforated tongue whereby a substantial portion of the aspirating gas is caused to flow in a direction opposite the movement of the filaments or exhaust through small holes in the rear wall of the shroud or funnel member. This fluid dissipation is in addition to the radial exhaust which takes place in the perforated tongue member.

Regardless of the process for manufacturing filter rods, the filter rod must have a nominally constant cross-sectional size and should be of uniform mass per unit length. The pressure drop or resistance to air flow through the filter rod should also be constant along its length. The length of the filter tip which is combined with a cigarette to form filter tip cigarettes may be in the range of 10 to 30 millimeters.

It is important from the smoker's point of view that the draw characteristics, the resistance to air flow through the length of filter rod, should be reasonably uniform. Some factors influencing the resistance to airflow along a filter rod are the fiber density, by which is meant the number of fibers per unit cross-sectional area; the denier of the fibers; the degree of crimping of the fibers; and the degree of fiber opening or "bloom". Some of these factors affect the mass per unit length of the filter rod so that variations of mass per unit length of the filter rod to some extent reflect variations in the resistance to airflow along the rod. The higher the mass per unit length of the rod the greater the resistance to airflow through that length of filter rod.

There is an ever increasing concern among filtered cigarette manufacturing companies with improving productivity and quality, reducing waste, and generally cutting costs. New high speed rod making machines run at speeds of 400 meters per minute or more. Prior art rod making processes are generally designed to run at speeds of about 200 meters per minute. When running at speeds of 400 meters per minute or more, it has been found that the maximum tow utilization processes of the prior art produced the aforementioned undesirable tow density variations. Tow density variations as previously noted are undesirable since the resistance which filter rod sections, including such variations offer to the passage of cigarette smoke, varies rendering inconsistent the draw characteristics of cigarettes to which filter tips formed from such filter rod sections are applied.

Accordingly, it is an object of this invention to provide a high speed process for the preparation of cigarette filter rods having high tow utilization in terms of pressure drop per unit rod weight without producing substantial tow density variations.

It is another object of this invention to provide high speed apparatus suitable for the preparation of a cigarette filter rod having high tow utilization in terms of pressure drop per unit rod weight without producing substantial tow density variations.

Other objects and advantages of the invention will become apparent from the following detailed description and claims taken in conjunction with the accompanying drawings wherein:

Figure 1:
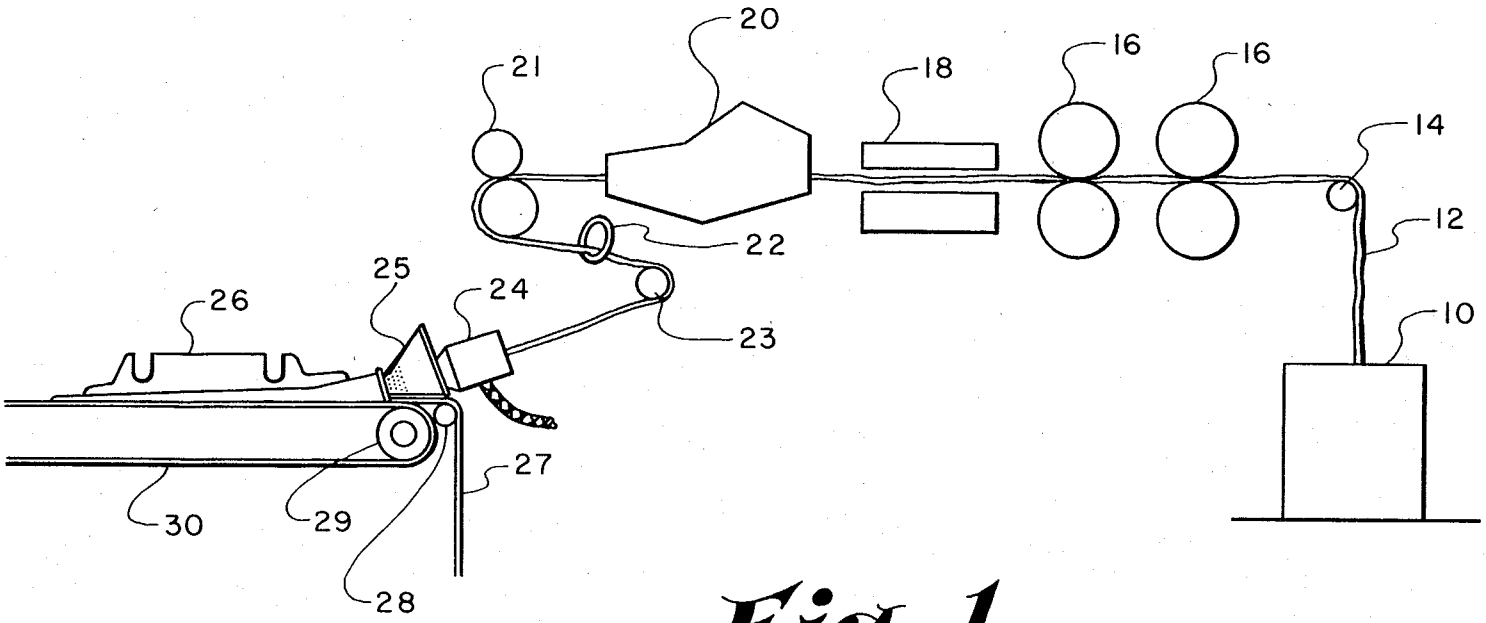
FIG. 1 is a diagramatic view of an apparatus suitable for the practice of the present invention.

In accordance with this invention, it has now been discovered that in a high speed process for the preparation of cigarette filter rods having high tow utilization in terms of the pressure drop per unit rod weight, that tow density and pressure drop variations may be minimized by positioning a tow controlling means downstream from the final set of feed rolls employed in a cigarette tow opening system, that is to say intermediate the feed rolls and the rod making device. The tow controlling means serves to control tow width and direction. The tow controlling means also serves to control tension by imparting at least some drag to the running tow band. Preferably, the tow controlling means is employed in conjunction with a rod making device having a pneumatic forwarding jet being positioned up-stream of a garniture of the rod making device, the tow controlling means being positioned so as to direct the tow path along the longitudinal axis of the pneumatic forwarding jet. Intermediate the pneumatic forwarding jet and the garniture of the rod making device it is preferred to position a perforated funnel member which has the ability to radially exhaust air from the pneumatic forwarding device. The funnel member should have a volume sufficient to allow tow to be over fed and accumulate in a relaxed state within the funnel. Preferably, the funnel should have a depth greater than or equal to three and one half inches, an entrance diameter of about 4 inches and an exit diameter of about one and one quarter inches. Most preferably the perforations of the funnel are positioned nearest the exit end of the funnel. The exit end of the funnel is recessed into the tongue of the garniture of the rod making device, while the pneumatic forwarding jet is recessed into the mouth of the funnel. It should be understood that the perforated tongue may be either perforated or un-perforated for purposes of the instant invention. Preferably, the tow width, tension and direction controlling means is either a rod or freely rotating roll. The rod or freely rotating roll is preferably about four to 10 inches long and most preferably four inches long and about one and one half inches in diameter and flanged at both extremies. The flanging is preferred in order that a tow band of desired width is achieved. Most preferably, a ring guide preceeds the tow controlling means so as to prereduce the band width prior to stabilization of the band width on the flanged rod or freely rotating roll. It should be understood that a fixed position of the rod or freely rotating roll is preferred in order to accurately control tow band direction, however, a floating mount of the rod or freely rotating roll, i.e. a dancer roll, may be employed where tension control is of greater importance.

For purposes of this invention, the pneumatic forwarding jet is preferably of cone-shaped construction, having a greater cross-section on the entrance end than on the exit end. The jet is fabricated such as to have inner and outer cone members which are joined so as to encircle a chamber, the jet being provided with means for the injection of a gas into the chamber. Air injected into the chamber exhausts at the small or exit end of the jet whereby a continuous filament tow may be motivated through the jet. Jets of this type are set forth in U.S. Pat. Nos. 3,050,430 and 3,016,945. A pneumatic forwarding or transport jet which has been found to be especially suitable is model number 61-0-0-DF marketed by Hauni-Werke Körber and Co. KG Hamburg, West Germany.

As previously noted, the process and apparatus of the instant invention provide a means for minimizing tow density variations in a high speed process for the preparation of cigarette filter rods having high tow utilization in terms of pressure drop per unit rod weight. By minimizing tow density variations or weight variations pressure drop variations are also reduced. More specifically, it has been found that the process and apparatus of the instant invention will reduce pressure drop coefficient of variation to less than 3.0 and weight coefficient of variation to less than about 1.6 for any combination of weight and pressure drop of a given tow item at any rodmaker speed. The statistical investigation of the improvement obtained by the use of the apparatus and process of the instant invention is based on F-distribution. In F-distribution, when samples are taken from two independent populations, their variances are also independent and both $S_1^2$ and $S_2^2$ are unbiased estimators of the population variances, if the populations are infinite or if sampling with replacement. That is to say $S_1^2$ is an unbiased estimator of $\sigma_1^2$ (population standard deviation 1) and $S_2^2$ is an unbiased estimator of $\sigma_2^2$ (population standard deviation 2). The ratio of $\sigma_1^2$ to $\sigma_1^2$ is equal to 1.00 if the two variances are equal, and the mean ratio of $S_1^2$ to $S_2^2$ is also equal to 1.00 if the population variances are equal. If the two populations are both normal and have equal variances, then the ratio of the two sample variance values are distributed as F with $n_1-1$ and $n_2-1$ degrees of freedom.

The term coefficient of variation (CV) is a means for comparing the dispersion of two series by expressing the standard deviation as a percent of the mean of the series. In the instant invention, the mean of the series $\sigma$ is a value encompassing 66% of all samples. The coefficient of variation (CV) may then be defined as follows:

$$CV = \frac{\text{average sample deviation}}{\text{average sample value}} \times 100$$

A better understanding of the invention may be had by turning to FIG. 1 of the drawings wherein a tow 12 of continuous cellulose acetate filaments, preferably having about 5 to 15 crimps per inch, an acetyl value of 38 to 41 percent, a circular or non-circular cross section, and a total denier of about 20,000 to about 120,000 or more is removed from a tow bale 10 and passed over guide means 14 to opener 16. The purpose of opener 16 is to cause deregistration of the crimps of the individual filaments and thus, provide a tow having improved uniformity and bulkiness. In the drawings, opener 16 is a threaded roll opener of the type generally described in U.S. Pat. No. 3,032,829 to Mahoney et al and U.S. Pat. No. 3,156,016 to Dunlap et al. Essentially, the threaded roll opener shown comprises two pairs of rolls with at least one roll of one pair being driven. Desirably, at least one roll of each pair has a patterned surface, preferably composed of circumferential or helical grooves. However, the roll pairs may be different, e.g. only one roll of one pair need be grooved. When the tow passes through the rolls, individual filaments of the tow are differentially restrained causing a longitudinal shifting of the relative location of the crimps of the individual filaments. It is to be understood of course, that other openers, for example, those producing deregistration by air turbulence or flexing of the tow may also be suitably employed.

After passing through opener 16, tow 12 is commonly passed through a banding jet 18 which spreads the tow by application of one or more air streams into a flat band of about 3 to 8 times its original width and causes further separation of the individual filaments. A suitable banding jet may be, for instance, that banding jet set forth in U.S. Pat. No. 3,226,773. However, other means for achieving filament separation, such as equipment utilizing electrostatic forces, are known in the art and may also be used for this purpose.

The open tow is then passed through plasticizer applicator 20 which treats the surface of the individual filaments with a plasticizing liquid, preferably an organic ester such as triacetin to cause bonding of the filaments. Other suitable plasticizers include, for example, triethyl citrate, dimethylethyl phthalate, or the dimethyl ether of triethylene or tetraethylene glycol. In the drawings, plasticizer applicator 20 may be a centrifugal plasticizer applicator of the type described in U.S. Pat. No. 3,387,992, which is a device employing a rotating disc for application of the plasticizer. Other applicators which are adapted to apply plasticizers to a continuous web include wick brush or spray nozzle type plasticizer applicators.

After treatment of the tow with plasticizer, the tow is passed into the nip of a pair of delivery rolls 21 through guide member 22. Guide member 22 reduces the width of the opened tow band prior to passage over idler roll 23.

After passing about idler roll 23, the open tow is passed to pneumatic forwarding jet 24 which may be a jet such as model number 61-0-0-DF marketed by Hauni-Werke Körber and Co. KG Hamburg, West Germany. Pneumatic forwarding jet 24 pushes the open tow through perforated funnel member 25 which is positioned in the tongue of garniture member 26. Garniture member 26 is also supplied with suitable wrapping paper 27 by means of driven roll 28, both wrapping paper 27 and tow 12 being supported by means of endless belt member 30 which is driven by means of roller member 29.

Figure 2:
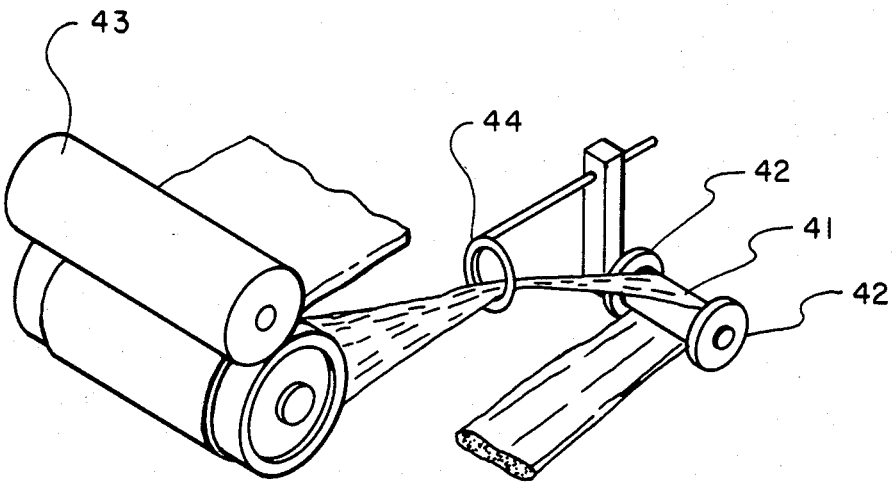
FIG. 2 is a perspective view of the idler roll arrangement used in the embodiment of FIG. 1.
Figure 3:
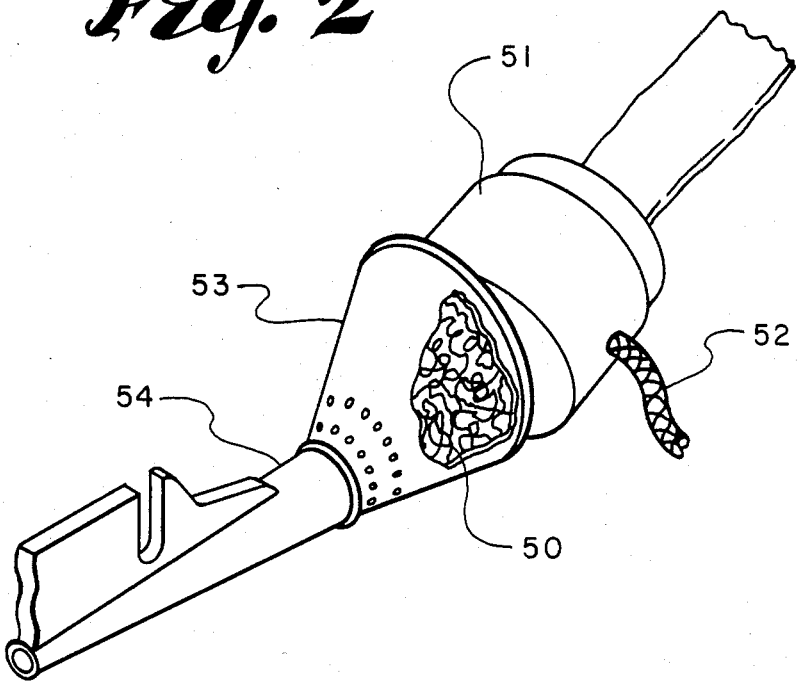
FIG. 3 is a perspective view of the perforated funnel arrangement used in the embodiment of FIG. 1.

A better understanding of the geometry of the idler roll may be had from FIG. 2 of the drawing. In FIG. 2 it may be seen that idler roll 41 has flanged members 42 secured to the terminal portions thereof. Tow passing from the nip of a pair of driven feed rolls 43 is caused to be compressed in width by passage through ring guide 44. The tow band is then passed from ring guide 44 about idler roll 41 whereby the tow band width is precisely controlled at about four inches and the direction of feed of the tow band to the rod forming device is determined. As previously noted the tow band should be fed into the pneumatic forwarding jet along the longitudinal axis of the jets processing bore, that is to say, the tow band should not ride on the edge portion of the entrance orifice of the pneumatic forwarding jet. This configuration may be clearly seen in FIG. 3 of the drawings wherein the tow controlled at a predetermined width enters pneumatic forwarding jet 51, pneumatic forwarding jet 51 being equipped with air supply line 52. Pneumatic forwarding jet 51 is recessed into funnel member 53. Funnel member 53 has perforations positioned near the exit end thereof and is recessed into garniture tongue member 54. Perforations of funnel member 53 allow air from pneumatic forwarding jet 51 to escape radially to the path of the tow being advanced into the filter rod forming device. Preferably, funnel member 53 is perforated at the funnel exit portion. As previously noted, funnel member 53 has sufficient volume to allow the tow to be over fed and accumulate in a relaxed state within funnel member 53 without over flowing and, consequently snagging on the edge portion of funnel member 53. As can be seen in FIG. 3 of the drawings, funnel member 53 is partially broken, illustrating the accumulation of over fed tow 50 within funnel member 53.

A further understanding of the invention will be had from the following examples which illustrate the improvement in tow density variation obtained from the process and apparatus of this invention, in the preparation of cigarette filter rods having high tow utilization in terms of pressure drop per unit rod weight.

EXAMPLE 1

Filter rods were prepared from 3.3 denier per filament, F cross section cellulose acetate tow having a total denier of 44,000 using the embodiment depicted in FIG. 1 of the drawings at running speeds of 400 meters per minute, the run being for a period of 45 minutes with samples being taken every 5 minutes. Twenty five rods are selected from the aforementioned 8 sample portions, the rods having preselected circumferences of 24.8 plus or minus 0.05 millimeters. In order to eliminate possible variations induced by the addition of plasticizer however, plasticizer was not added as illustrated in FIG. 1 of the drawings, but rather the tow line was passed through the plasticizer apparatus running empty. The weight and encapsulated pressure drop of 102 millimeter rod lengths were determined and were found to be as follows.

| | |
|---|---|
| Pressure Drop (E Δ P) = 590 mm water | Weight = .8911 grams |
| $\sigma$ = 15.8 | $\sigma$ = .0106 |
| Coefficient of Variation (CV) = 2.67 | Coefficient of Variation (CV) = 1.19 |

EXAMPLE 2

The process of Example 1 was repeated except that running speeds were reduced to 200 meters per minute. Weight and encapsulated pressure drop for 102 millimeter rod lengths were found to be as follows:

| | |
|---|---|
| Pressure Drop (E Δ P) = 607 mm water | Weight = .9091 grams |
| $\sigma$ = 17.7 | $\sigma$ = .0144 |
| Coefficient of Variation (CV) = 2.91 | Coefficient of Variation (CV) = 1.57 |

EXAMPLE 3

The process of Example 1 was repeated except that tow 12 is not passed through ring guide 22 and about idler roll 23 but rather is transmitted directly from drive rolls 21 to pneumatic forwarding jet 24, the entry angle of the tow into pneumatic forwarding jet 24 being appropriately adjusted so as to eliminate any tow drag upon entry into pneumatic forwarding jet 24. The weight and encapsulated pressure drop of 102 millimeter rod lengths were determined and found to be as follows.

| | |
|---|---|
| Pressure Drop (E Δ P) = 608 mm water | Weight = .9080 grams |

-continued

| | |
|---|---|
| $\sigma$ = 23.4 | $\sigma$ = .0143 |
| Coefficient of Variation (CV) = 3.85 | Coefficient of Variation (CV) = 1.56 |

EXAMPLE 4

The process of Example 3 was repeated except that running speeds of 200 meters per minute are employed. The weight and encapsulated pressure drop of 102 millimeter long rod lengths are determined and found to be as follows.

| | |
|---|---|
| Pressure Drop (E Δ P) = 597 mm water | Weight X = .8670 grams |
| $\sigma$ = 24.47 | $\sigma$ = .0166 |
| Coefficient of Variation (CV) = 4.10 | Coefficient of Variation (CV) = 1.91 |

EXAMPLE 5

The process of Example 1 was repeated except that the rod forming apparatus of U.S. Pat. No. 3,173,188 was employed, the funnel or shroud configuration being substantially as set forth in FIGS. 3 and 4 of the drawings. The perforated tongue of U.S. Pat. No. 3,173,188 was also employed rather than a unperforated tongue of FIG. 1 of the drawings of the instant invention. Weight and encapulated measure drop for 102 mm. rod lengths were found to be as follows:

| | |
|---|---|
| Pressure Drop (E Δ P) = 578 mm water | Weight = .8769 grams |
| $\sigma$ = 25.8 | $\sigma$ = 0.0150 |
| Coefficient of Variation (CV) = 4.5 | Coefficient of Variation (CV) = 1.71 |

EXAMPLE 6

The process of Example 5 was repeated except that running speeds were reduced to 200 meters per minute. Weight and encapsulated pressure drop for 102 mm. rod lengths were found to be as follows:

| | |
|---|---|
| Pressure Drop (E Δ P) = 650 mm water | Weight X = .9219 grams |
| $\sigma$ = 33.3 | $\sigma$ = .022 |
| Coefficient of Variation (CV) = 5.1 | Coefficient of Variation (CV) = 2.33 |

EXAMPLE 7

Filter rods were prepared from 3.3 denier per filament, F-cross section cellulose acetate tow having a total denier of 44,000 using the tow opening system as set forth in FIG. 2 of U.S. Pat. No. 3,099,594. However, in order to eliminate possible variations induced by the addition of plasticizer, the tow opening system was operated without the use of plasticizer. After exiting feed rolls 7 as illustrated in FIG. 2 of U.S. Pat. No. 3,099,594, the opened deregistered tow was processed as illustrated in FIG. 1 of the drawings of the instant invention, that is to say, the opened deregistered tow was then passed through ring guide 22 of FIG. 1 of the drawings of the instant invention. Rod maker speeds of 400 meters per minute were employed. The weight and encapsulated pressure drop of 102 millimeter rod lengths were determined and were found to be as follows.

| | |
|---|---|
| Pressure Drop (E Δ P) = 682 mm water | Weight = 0.9557 grams |
| $\sigma$ = 20.8 | $\sigma$ = 0.013 |
| Coefficient of Variation (CV) = 3.05 | Coefficient of Variation (CV) = 1.36 |

EXAMPLE 8

Filter rods were prepared from 3.3 denier per filament, F-cross section cellulose acetate tow having a total denier of 31,000 using the embodiment depicted in FIG. 1 of the drawings at a running speed of 400 meters per minute. Running conditions were adjusted such that an average pressure drop of 259 mm. of water and an average rod weight of 0.6311 grams was obtained. Rods monitored over a 24 hour period were found to have an average FILTRONA hardness of 90.4%.

EXAMPLE 9

Filter rods were prepared from 3.9 denier per filament, F-cross section cellulose acetate tow having a total denier of 39,000 using the embodiment depicted in FIG. 1 of the drawings except that tow 12 is not passed through ring guide 22 and about idler roll 23 but rather is transmitted directly from drive rolls 21 to pneumatic forwarding jet 24, the entry angle of the tow into pneumatic forwarding jet 24 being appropriately adjusted so as to eliminate any tow drag upon entry into pneumatic forwarding jet 24. Running speeds of 400 meters per minute were employed and operating conditions were adjusted so as to obtain an average rod pressure drop of 251 mm. of water and an average rod weight of 0.6609 grams. Over a 24 hour period rods were found to have an average Filtrona hardness value of 90.3%.

EXAMPLE 10

The process of Example 8 was repeated except that running conditions were adjusted so that an average rod pressure drop of 267 mm. of water and an average rod weight of 0.6394 was obtained. Rods monitored over a 24 hour period were found to exhibit an average Filtrona hardness of 90.4%.

EXAMPLE 11

The process of Example 9 was repeated except that 3.3 denier per filament, F-cross section cellulose acetate tow having a total denier of 35,000 was employed. Running conditions were adjusted such that an average rod pressure drop of 281 mm. of water and an average rod weight of 0.6462 grams was obtained. Over a 24 hour period the rods are found to exhibit an average filtrona hardness of 90.2%.

EXAMPLE 12

The process of Example 8 was repeated except that running conditions were adjusted as such that an average rod pressure drop of 293 mm. of water and an average rod weight of 0.6741 grams was obtained. Rods monitored over a 24 hour period were found to exhibit an average Filtrona hardness of 92.4.

EXAMPLE 13

The process of Example 9 is repeated except that 4.2 denier per filament, F-cross section cellulose acetate tow having a total denier of 40,000 is employed. Running speeds are adjusted such that an average rod pressure drop of 304 mm. of water and an average weight of 0.7479 grams is obtained. Over a 24 hour period rods are found to exhibit an average Filtrona hardness value of 94.4%.

It is apparent from the foregoing Examples and more specifically Examples 1 to 4, that the process and apparatus of the instant invention significantly reduces filter rod weight and pressure drop coefficient of variation at running speeds in the range of 200 to 400 meters per minute. Examples 5 and 6 show that the prior art process and apparatus are represented by U.S. Pat. No. 3,173,188 do not, at comparable running speeds, achieve the coefficient of variation reductions obtained with the process and apparatus of the instant invention. Example 7 is illustrative of the applicability of the process and apparatus of the instant invention to other tow opening systems. Example 8 to 13 are illustrative of the improvement in filter rod hardness obtained by the process and apparatus of the instant invention. That is to say, at substantially equivalent rod pressure drops, equivalent hardness values are obtained at substantially lower rod weights when the process and apparatus of the instant invention is employed.

Pressure drop as reported in the preceeding examples is measured by the following method: Air is drawn through a 102 millimeter length of the fully encapsulated filter at a steady rate of 1050 cubic centimeters per minute and the resulting pressure difference across the filter is measured by means of a water manometer. The result is expressed in millimeters of water gauge.

Cigarette filter rod hardness as reported in the preceeding examples is measured by means of a "FILTRONA" Tester (manufactured by Cigarette Components Limited), by a test in which rod (for example a length of 102 millimeters) having a mean diameter (D), of about 7.8 millimeters, is compressed between two plates provided in the instrument. The rod is subjected to compression for 15 seconds by a load of 300 grams applied to opposite sides of the cylindrical surface of the rod and the average depression (A), that is the decrease in diameter of the rod, measured. The hardness is the diameter of the sample measured at a load of 300 grams and expressed as a percentage of the original diameter, that is, it is given by the following formula:

$$\text{Hardness } \% = [(D-A)]/D \times 100$$

Figure 4:
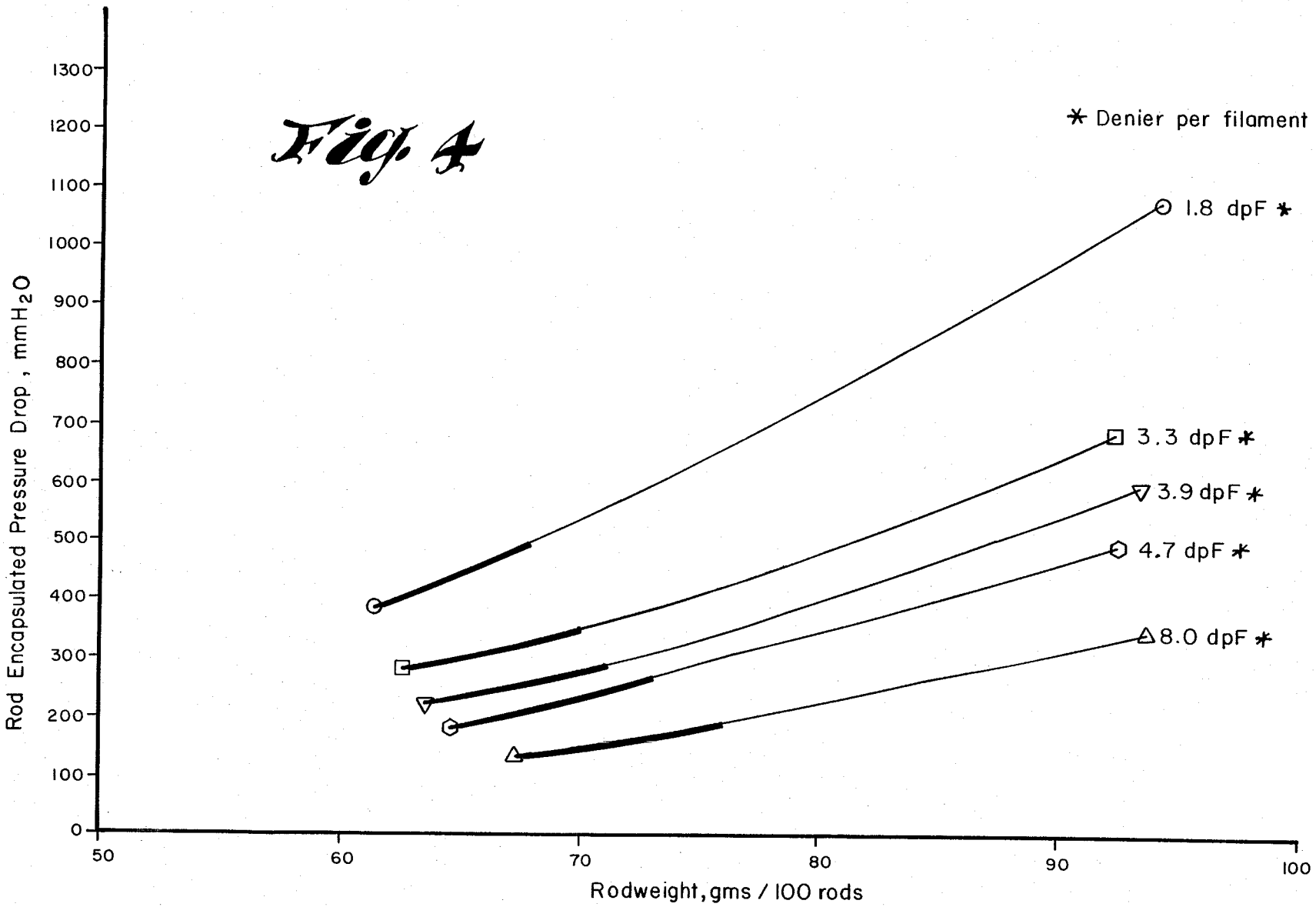
FIG. 4 is a graph plotting filter rod weight against pressure drop for cigarette tows of from 1.8 to 8.0 denier per filament.

The average value for 100-rod samples obtained at the minimum and maximun weight levels define the weight range capability and the pressure-drop range capability of a specific tow item. These values are fairly constant under equivalent processing conditions. The improved versatility of tow items as a result of this invention is illustarted by FIG. 4 of the drawings wherein rod weight in grams is plotted against rod pressure drop of millimeters of water. As can be seen in FIG. 4 of the drawings a vastly extended filter rod range is obtained for 1.8 to 8.0 denier per filament tow items, the light line being representative of rods produced according to the teachings of the instant invention while the heavy line is representative of the same tow item processed according to the prior art. It should be noted that for each tow item, the relationship between the rod pressure drops for each tow item and the rod weight necessary to obtain that pressure drop is less than would be expected by linear extrapolation.

Figure 5:
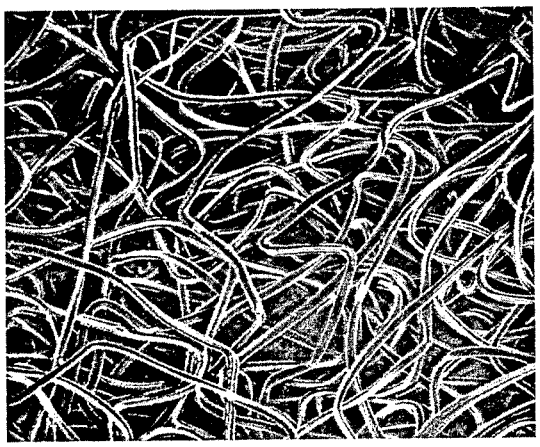
FIG. 5 is a photomicrograph magnified 100 times of a longitudinal axis cross section of a range extended filter rod of this invention.
Figure 6:
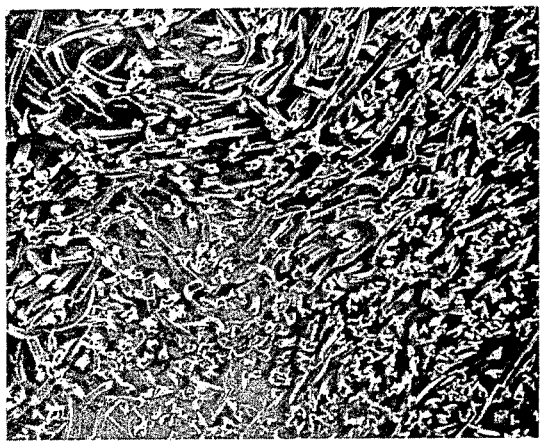
FIG. 6 is a photomicrograph magnified 100 times of a radial cross section of the filter rod of FIG. 5.

A better understanding of the reason for the improved range extension as illustrated in FIG. 4 of the drawings may be had by turning to FIGS. 5 through 8 of the drawings. FIG. 5 is a photomicrograph magnified 100 times of a cross section of a filter plug of the instant invention, the cross section being taken through the longitudinal axis of the plug. The rod was prepared from 3.3 denier per filament F-cross section tow having a total denier of 39,000, the rod being prepared substantially according to the process set forth in Example 1. As can be seen in FIG. 5, the individual filament plugs are positioned in a direction approaching cross wise, that is to say perpendicular, to the longitudinal axis of the filament bundle. FIG. 6 is a photomicrograph of a radial cross section of the filter rod of FIG. 5 of the drawings. As can be seen, the filaments are tightly packed which is indicative of the increased rod weight potential existing by utilization of the process and apparatus of the instant invention.

Figure 7:
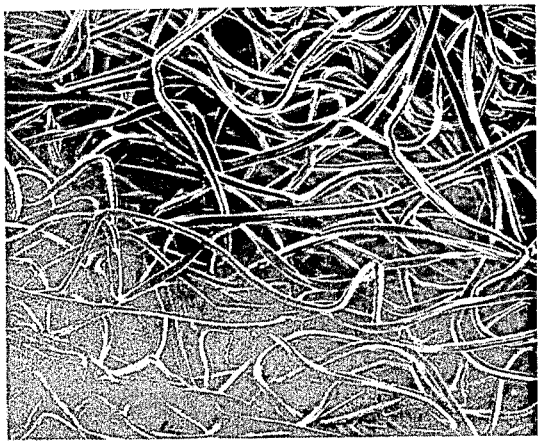
FIG. 7 is a photomicrograph magnified 100 times of a longitudinal cross section of a prior art filter rod.
Figure 8:
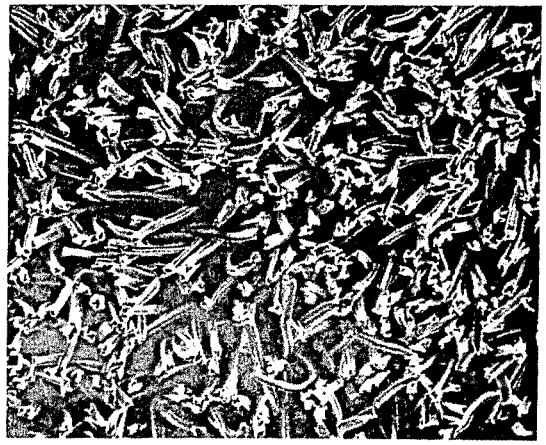
FIG. 8 is a photomicrograph magnified 100 times of a radial cross section of the filter rod of FIG. 7.

In contradistinction to the filament positioning of the rod of FIGS. 5 and 6 of the drawings, a significantly different filament positioning may be seen in a prior art filter plug as represented by FIGS. 7 and 8 of the drawings. FIG. 7 is a photomicrograph magnified 100 times of a cross section taken through the longitudinal axis of the plug, the plug being prepared substantially according to the process set forth in Example 3.The plug is prepared from 3.3 denier per filament F-cross section tow having a total denier of 39,000. As can be seen in FIG. 7, the filter rod has a minimal number of filaments which are positioned perpendicular to the longitudinal axis of the filament bundle. Moreover, as can be seen in FIG. 8 of the drawing which is a radial cross section of the filter rod of FIG. 7, the filaments are much less tightly spaced when compared with the filaments of FIG. 6 of the drawings which is representative of the filter rod prepared according to the process and apparatus of the instant invention.

In additions to the visual differences which are readily apparent from a viewing of FIGS. 5 through 8 of the drawings, the rod samples of FIGS. 5 through 8 of the drawings were also analyzed using the "Quantimet" (analytical device manufactured by Cambridge Instrument Company of Monsey, N.Y.) so as to determine fiber orientation angle distributions within the longitudinal sections. Other rod characteristics such as the agglomeration factor and packing fraction also measured the results of which appears in the following table.

| Rod Description | System Description | (1) | (2) | (3) $\bar{X}$ | (3) $\sigma$ | (4) | Pressure Drop |
|---|---|---|---|---|---|---|---|
| 3.3 F/ 39,000 | | | | | | | |

-continued

| Rod Description | System Description | (1) | (2) | (3) $\bar{X}$ | (3) $\sigma$ | (4) | Pressure Drop |
|---|---|---|---|---|---|---|---|
| FIGS. 7 & 8 | Example 3 (Prior Art) | .1050 | 47.1 | 44.3 | 15.03 | 1.47 | 431 |
| FIGS. 5 & 6 | Example 1 (Instant (Invention) | .1225 | 54.4 | 51.8 | 21.20 | 1.45 | 626 |

(1) Packing Fraction
(2) Calculated Crimp Angle
(3) Measured Fiber Orientation ($\bar{x}$ = average, $\sigma$ = standard deviation)
(4) Measured Agglomeration Having thus disclosed the invention, what is claimed is:

1. In an apparatus suitable for a range extension process of manufacturing filter elements from opened and deregistered crimped continuous filament tow, wherein said tow is conducted from a mechanical forwarding means through an aspirating jet into a compacting means immediately adjacent said jet and wherein means are provided for dissipating aspirating fluid, the improvement comprising: (a) a tow controlling means positioned intermediate said mechanical filament forwarding means and said aspirating jet, said tow controlling means controlling width and direction and imparting at least some drag to said opened and deregistered tow and; and (b) a perforated funnel member positioned intermediate said aspirating jet and said compacting means, said perforated funnel member having sufficient volume to allow said tow to accumulate in a substantially tension free condition prior to being drawn into said compacting means whereby pressure drop and weight variations in resultant cigarette filter elements are reduced at extended points in range.

2. The apparatus of claim 1 wherein said tow controlling means is a means selected from the group consisting of an idler roll and a stationary rod member.

3. The apparatus of claim 1 wherein a ring guide member is positioned in advance of said tow controlling means whereby tow band width is reduced prior to passage over said tow controlling means.

4. The apparatus of claim 1 wherein the perforations of said funnel are positioned nearest the exit end of the funnel.

5. In a range extension process of manufacturing filter elements from opened and deregistered crimped continuous filament tow wherein the tow is conducted from a mechanical forwarding means through an aspirating jet into an immediately adjacent compacting means and wherein means are provided for dissipating aspirating fluid, the improvement comprising: (a) causing said tow to contact a tow controlling means positioned intermediate said mechanical forwarding means and said aspirating jet, said tow controlling means controlling said width and direction and imparting at least some drag to said tow; and (b) dissipating said aspirating fluids by means of a perforated funnel member positioned between said aspirating jet and said compacting means, said perforated funnel member having a depth sufficient to temporarily accumulate tow in a substantially tension free state prior to the tow being drawn into said compacting means whereby pressure drop and weight variations in resultant cigarette filter elements are reduced at extended points in range.

6. The process of claim 5 wherein said tow controlling means is a means selected from the group consisting of an idler roll and a fixed rod.

7. The process of claim 5 wherein said controlling means is positioned so as to cause said tow to pass through said aspirating jet substantially along the longitudinal axis of the processing bore of said jet.

8. The process of claim 5 wherein a tow width reducing ring guide is positioned in advance of said tow controlling means.

9. The process of claim 5 wherein the terminal portion of said aspirating jet is nested into the mouth of said funnel member and wherein the terminal portion of said funnel member is recessed into a tongue of said compacting means.

* * * * *